US007971963B2

(12) United States Patent
Imahashi et al.

(10) Patent No.: US 7,971,963 B2
(45) Date of Patent: Jul. 5, 2011

(54) LIQUID DISCHARGE METHOD AND LIQUID DISCHARGE HEAD

(75) Inventors: Yusuke Imahashi, Kawasaki (JP); Takashi Inoue, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 917 days.

(21) Appl. No.: 11/929,364

(22) Filed: Oct. 30, 2007

(65) Prior Publication Data

US 2008/0106574 A1 May 8, 2008

(30) Foreign Application Priority Data

Nov. 6, 2006 (JP) ..... 2006-300619

(51) Int. Cl.
*B41J 2/14* (2006.01)
*B41J 2/16* (2006.01)

(52) U.S. Cl. ..... 347/47; 347/10; 347/57

(58) Field of Classification Search ..... 347/10, 347/14, 19, 27, 37, 40, 42, 47, 57, 70, 81
See application file for complete search history.

(56) References Cited

U.S. PATENT DOCUMENTS 6,045,208 A * 4/2000 Hirahara et al. ..... 347/10
6,557,974 B1 5/2003 Weber

FOREIGN PATENT DOCUMENTS

JP 08-001930 A 1/1996

* cited by examiner

*Primary Examiner* — Thinh H Nguyen
(74) *Attorney, Agent, or Firm* — Canon USA Inc IP Division

(57) ABSTRACT

A liquid discharge method of a liquid discharge head having a discharge port which discharges a liquid, a channel which communicates with the discharge port and an energy generation unit which is disposed opposite to the discharge port and which generates energy for use in discharging the liquid. The method includes driving the energy generation unit, and then connecting a tip portion of the liquid discharged from the discharge port to the liquid at the discharge port via at least two liquid columns, and cutting the at least two liquid columns to separate the tip portion of the liquid from the liquid at the discharge port.

2 Claims, 7 Drawing Sheets

LIQUID DISCHARGE METHOD AND LIQUID DISCHARGE HEAD

BACKGROUND OF THE INVENTION

1. Field of the Invention

The present invention relates to a liquid discharge method in which discharge energy is applied to a liquid to discharge the liquid, and a liquid discharge head.

2. Description of the Related Art

In recent years, the market for ink jet recording devices has been rapidly growing due to the rapid growth of digital cameras and the spread of personal computers. The above ink jet recording device has features such as high-speed recording, high quality level, low noise, and recordability in various mediums, and is utilized mainly in applications such as photograph printing and postcard printing. An ink jet technology in which a predetermined amount of liquid is discharged in the form of particles to attach the liquid to the medium is also utilized in an industrial field, and the applications of the technology are increasing and varying. Therefore, further sophistication in performance of an ink jet discharge head and technical innovation have been accelerated.

In recent years, technical development of an ink jet discharge method has been advanced so as to stably discharge comparatively small liquid droplets as compared with a conventional method and reduce satellites generated behind a main droplet and having a diameter smaller than that of the main droplet. This development has been made in order to meet the needs of the market demanding higher definition images and high-speed recording and meet expectations that the technology be applied to the industrial field. The satellites generated behind the main droplet and having the diameter smaller than that of the main droplet cause numerous problems. For example, the problems include a problem caused by ink droplets that are easily influenced by air resistance, as a diameter of the droplets decreases. The problem is that satellites generated subsequently to a main ink droplet are influenced by an air current generated by the main ink droplet transmitted through the air, and are therefore shot at unexpected portions to disturb the image. Another problem is that, among the satellites, satellites having small particle diameters to such an extent that the satellites cannot be shot float as mist to cause contamination inside a recording device and failure of the device.

To reduce the number of satellites, it is proposed in Japanese Patent No. 2866848 that nozzles be substantially formed into a ring shape. It is disclosed in Japanese Patent No. 2866848 that surface tension of a nozzle portion is enlarged to satisfactorily separate ink at a nozzle hole from the nozzle portion and that the ink droplets are discharged in a state in which the droplets scarcely leave tails.

Moreover, it is proposed in U.S. Pat. No. 6,557,974 that a discharge port be formed so as to obtain an aspect ratio of the discharge port between a long axis and a short axis in a range of 2 to 5. It is disclosed in U.S. Pat. No. 6,557,974 that a large restoring force is given by a meniscus force to cut off tails of the ink droplets earlier at a position closer to an orifice plate. As a result, the tails of the ink droplets are shortened, and the number of satellites is greatly reduced.

Japanese Patent No. 2866848 discloses that a portion corresponding to the center of a ring shape to be formed is substantially required for formation of a ring-like discharge port. There is difficulty in actual manufacturing such portion.

Moreover, in U.S. Pat. No. 6,557,974, it is originally assumed that the liquid droplets have a large size of several ten pls. When the constitution of U.S. Pat. No. 6,557,974 is used in a head for discharging fine liquid droplets, a mechanism for separating the liquid droplets is not basically changed as compared with a conventional mechanism. The length of the tails is not considerably reduced. That is, the constitution of the U.S. Pat. No. 6,557,974 produces a satellite reduction effect in the case of a large discharge amount. However, when the discharge amount is as small as 10 pls or less, a sufficient satellite reduction effect is not seen.

As a result of investigation and development of the present inventors, the present inventors obtain the following finding with respect to a relation between a discharge speed and the satellites. It has been found that a length of the whole discharged liquid including the tail and the discharge speed have a correlation. As the discharge speed increases, the length of the whole liquid increases, that is, the satellites increase. With regard to the small liquid droplets in the case of a discharge amount of 10 pls or less, the tails lengthen on conditions such as a discharge speed of 10 m/s or more. The tails form the satellites having a particle diameter much smaller than that of the main droplet. When the discharge speed is as low as 10 m/s or less, the tails shorten, and generation of the satellites is inhibited. It has further been found that when the discharge speed is set to 5 m/s or less, the tail is not split, and is incorporated in the main droplet to form a single liquid droplet.

When the suppression of the satellites is only considered, it is a very effective technique to reduce the discharge speed. However, in order to improve reliability of shot precision and apply kinetic energy to the ink so that viscosity of the ink due to evaporation of a water content of the ink at the discharge port during halt can be overcome to discharge the ink, the reduction of the discharge speed cannot be an effective solution to the problem.

SUMMARY OF THE INVENTION

The present invention is directed to an ink jet discharge head in which satellites generated during discharge of ink can be reduced even on conditions such as a high discharge speed, and an ink jet discharge method.

According to an aspect of the present invention, there is provided a liquid discharge method of a liquid discharge head including a discharge port which discharges a liquid, a channel which communicates with the discharge port and an energy generation unit which is disposed opposite to the discharge port and which generates energy for use in discharging the liquid, the method includes driving the energy generation unit, and then connecting a tip portion of the liquid discharged from the discharge port to the liquid at the discharge port via at least two liquid columns; and cutting the at least two liquid columns to separate the tip portion of the liquid from the liquid at the discharge port.

According to the present invention, even on conditions such as the high discharge speed, the satellites generated during the discharge of the ink can be reduced.

Further features of the present invention will become apparent from the following description of exemplary embodiments with reference to the attached drawings.

DESCRIPTION OF THE EMBODIMENTS

Next, an embodiment of the present invention will be described with reference to the drawings.

Hereinafter, as the best mode for carrying out the present invention, an ink jet discharge head using an electricity-heat conversion member as a discharge energy generation unit will be described in an illustrative manner.

Figure 1A:
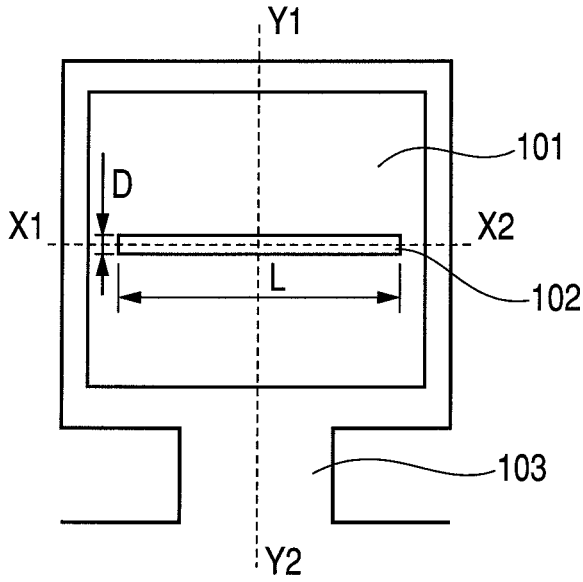
FIGS. 1A, 1B and 1C are diagrams illustrating a constitution of an ink jet discharge head according to one embodiment of the present invention.
Figure 1B:
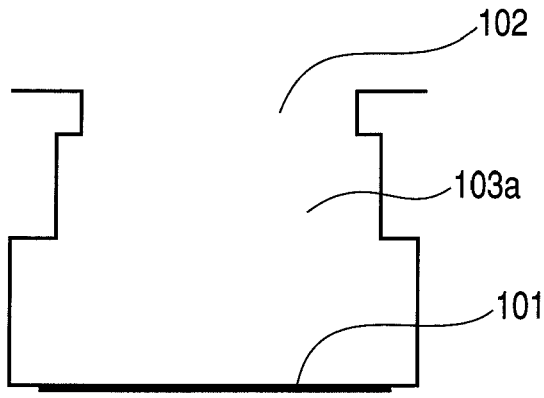
Figure 1C:
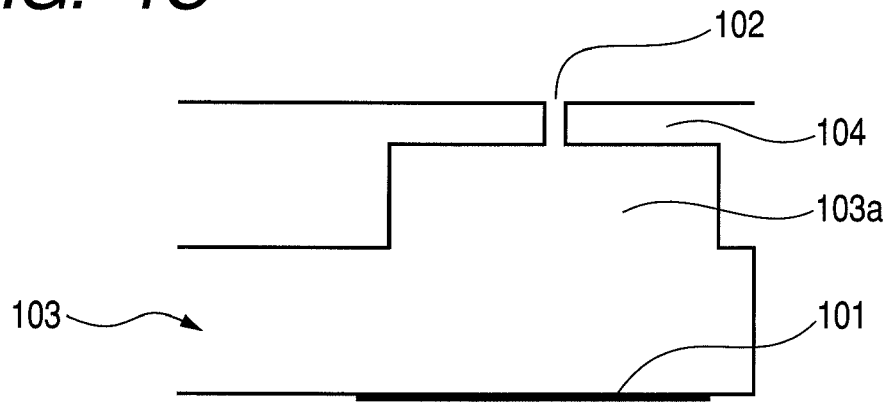

FIGS. 1A, 1B and 1C are diagrams illustrating a constitution of an ink jet discharge head according to one embodiment of the present invention. FIG. 1A is a plan view illustrating a nozzle portion of the ink jet discharge head. FIG. 1B is a sectional view of the constitution cut along the X1-X2 line of FIG. 1A. FIG. 1C is a sectional view of the constitution cut along the Y1-Y2 line of FIG. 1A.

As shown in FIGS. 1A, 1B and 1C, an orifice plate 104 provided with a slit-like discharge port 102 having a rectangular shape is arranged along an ink channel 103. The discharge port 102 is opened at a position facing a discharge energy generation device 101 arranged in a bubble generating chamber 103*a* formed at an end portion of the ink channel 103. These discharge port 102, ink channel 103, and discharge energy generation device 101 form an ink jet nozzle portion which discharges the ink.

According to investigation by the present inventor, it has been seen that a viscosity resistance of the ink to be discharged at an inner wall surface of the discharge port increases, when a slit opening having a large aspect ratio between a long axis and a short axis is used as the discharge port. Therefore, discharge energy generated by the discharge energy generation device 101 is consumed by the viscosity resistance of the ink. It is considered that ink droplets are not discharged from the discharge port in the worst case. To solve this problem, in the present embodiment, the discharge energy generation device 101 is arranged at the position which faces the discharge port 102 having a large aspect ratio between the long axis and the short axis. Furthermore, as shown in FIG. 1A, a size of the discharge energy generation device 101 is set so as to contain the discharge port 102 as viewed from above the ink jet nozzle portion. In consequence, the discharge energy generated by the discharge energy generation device 101 can efficiently be applied to the ink in the ink channel 103, and the viscosity resistance at the discharge port 102 can be overcome to discharge ink droplets from the discharge port 102.

Figure 2A:
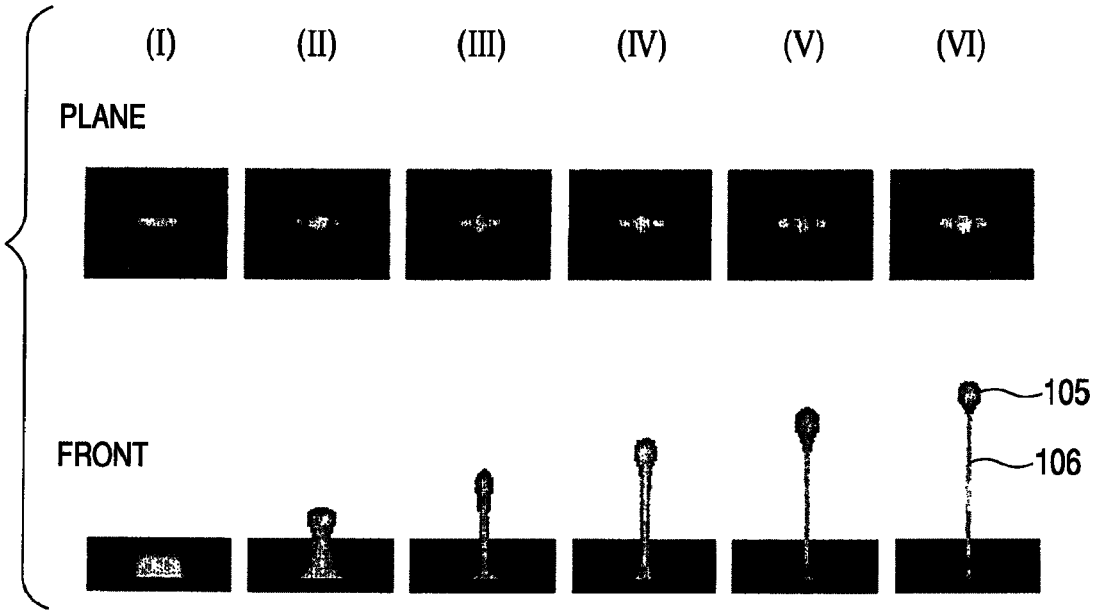
FIGS. 2A and 2B are diagrams illustrating a behavior of ink during discharge of the ink by an ink discharge simulation of the ink jet discharge head according to one embodiment of the present invention.
Figure 2B:
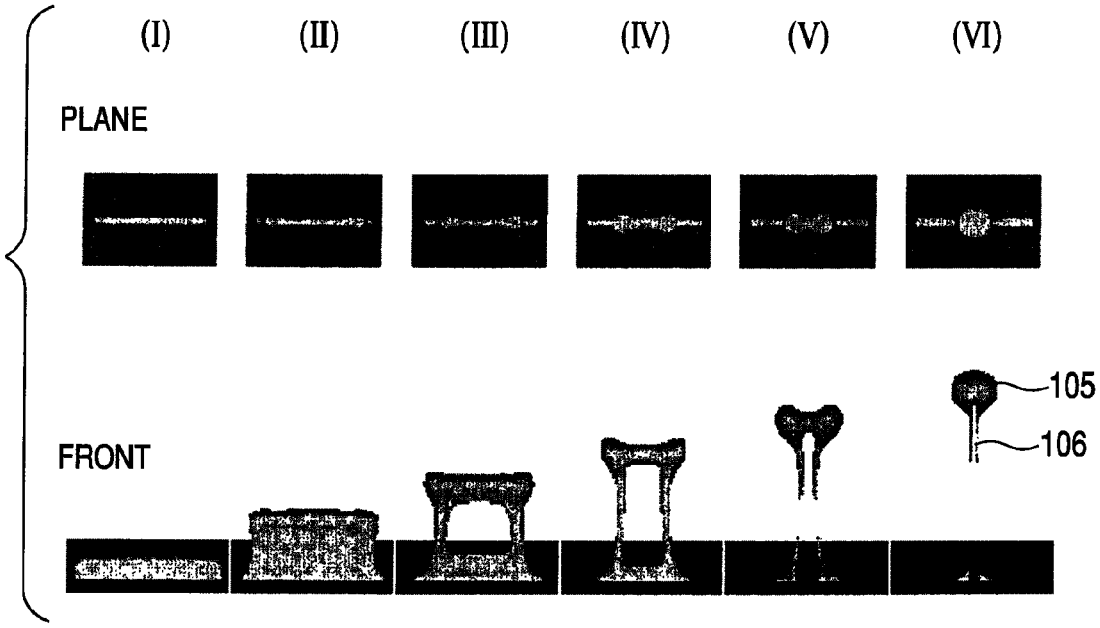

Next, a behavior of the ink during the discharge of the ink by the ink jet discharge head of the present embodiment will be described with reference to FIGS. 2A and 2B. FIG. 2A illustrates a simulation result of the behavior of the ink at a time when the ink is discharged from the discharge port having a relatively small aspect ratio (an aspect ratio of 5) between a long axis and a short axis. FIG. 2B illustrates a simulation result of the behavior of the ink at a time when the ink is discharged from the discharge port having a relatively large aspect ratio (an aspect ratio of 15) between the long axis and the short axis as compared with FIG. 2A.

When the discharge port has a small aspect ratio as shown in FIG. 2A and the discharge of the ink is started (i), the ink immediately gathers at the center (ii). Moreover, a main droplet 105 has such a discharged shape (a tail 106) that only one tail is left behind the main droplet (iii to v), and the droplet is cut from the ink at the discharge port (vi). Afterward, owing to an effect of surface tension, the tail (a liquid thread/a liquid column) 106 forms a satellite having a particle diameter smaller than that of the main droplet 105 with an elapse of time. Such a discharge shape will hereinafter be referred to as an A-type discharge shape.

When the discharge port has a large aspect ratio as shown in FIG. 2B and the discharge of the ink is started (i), the ink is separated at the center (iii), and two tails (liquid threads) 106 are formed behind the main droplet 105, which is a tip portion of the discharged ink (iii, iv). Moreover, the tail 106 is separated into two and cut from the ink at the discharge port (v, vi). Afterward, owing to the effect of the surface tension, the tails 106 form the satellites having a particle diameter smaller than that of the main droplet 105 with the elapse of time. In the example shown in FIG. 2B, since the two separated tails 106 are discharged, the tails 106 are easily cut from the ink at the discharge port 102. Therefore, the tails 106 to be cut shorten, and the generation of the satellite is inhibited. In the ink jet discharge head of the present embodiment, during the discharge, since the two separated tails 106 are sufficiently short and are absorbed by the main droplet 105, satellites are not generated or the satellites are reduced. Such a discharge shape that the two separated tails 106 are cut from the ink at the discharge port 102 will hereinafter be described as a B-type discharge shape.

As a result of the investigation by the present inventor, it has been found that the aspect ratio of the slit-like discharge port 102 between the long axis and the short axis and the A-type and B-type discharge shapes have a large correlation.

Figure 3:
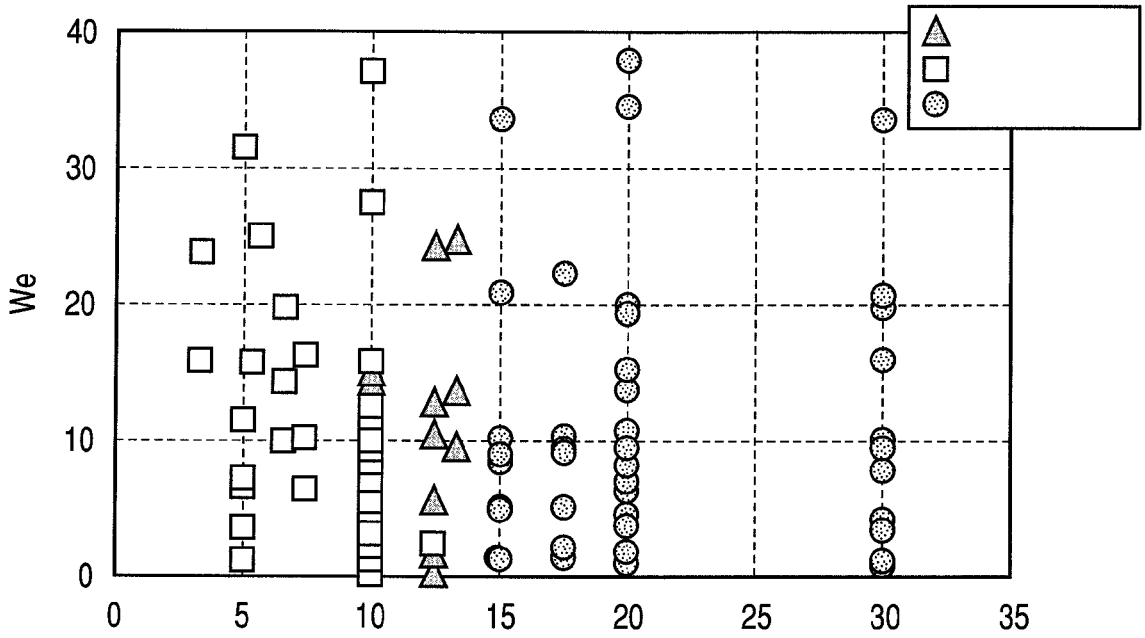
FIG. 3 is a diagram illustrating a distribution of discharge shapes in a relation between an aspect ratio of a discharge port and the We number.

FIG. 3 illustrates a distribution of the discharge shapes in a relation between the aspect ratio of the discharge port and the We (Weber) number. Here, the We number indicates the Weber number represented by $We=\rho DV^2/\gamma$, in which D is a width of the slit-like opened discharge port 102 in a short axis direction, $\gamma$ is the surface tension of the ink, $\rho$ is a density of the ink, and V is a velocity of the ink in a discharge direction. It is to be noted that the ink is separated at the center during the discharge, but sometimes gathers at the center again before the ink is cut from the ink at the discharge port 102, and one tail is left. This discharge shape is supposedly positioned between the A-type and the B-type, and will be referred to as a C-type discharge shape.

It has been seen from FIG. 3 that the discharge shape and the We number do not have any correlation, and the A-type, B-type and C-type discharge shapes are determined on the basis of the aspect ratio. Furthermore, it has been seen that as a condition of the B-type discharge shape in which the tail subsequent to the main droplet shortens and the formation of the satellite is inhibited, the discharge port 102 has an aspect ratio of 15 or more. That is, as the condition, a relation of L≧15D is satisfied, in which L is a length of the discharge port 102 in a long axis direction and D is a width of the port in the short axis direction.

Figure 4:
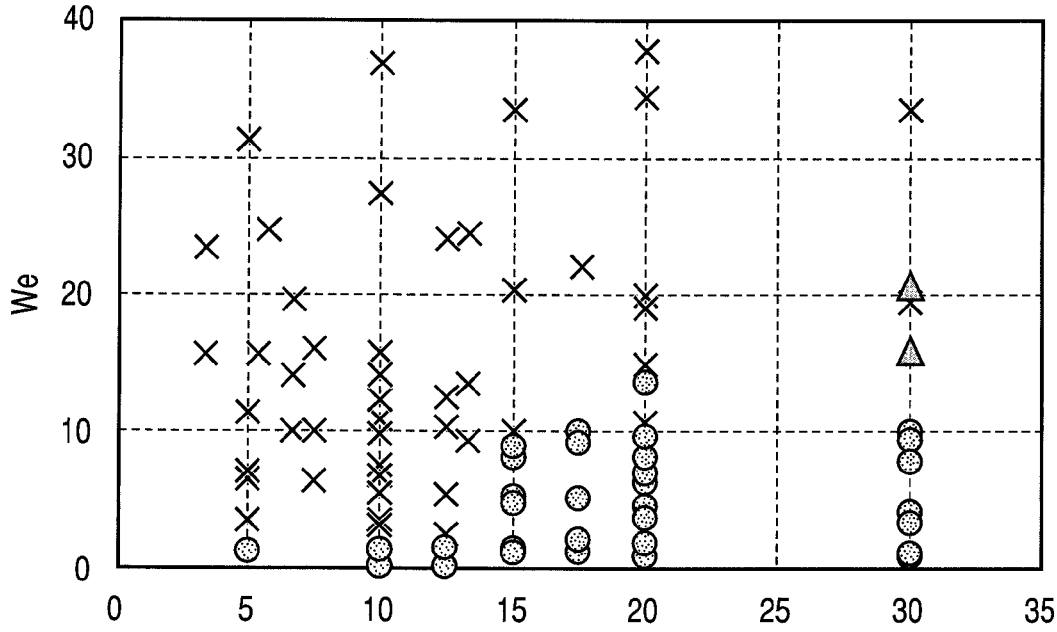
FIG. 4 is a diagram illustrating a distribution of generated satellites in a correlation between the We number and a length of a tail.

Furthermore, as a result of the investigation of the present inventor, it has been found that the We number and the length of the tail have a large correlation. Therefore, a discharge amount region is limited to a region of a remarkably small amount of 2 pls, and it is checked whether or not the satellite is generated. The result is shown in FIG. 4. A case where any satellite is not generated is indicated as "o", and a case where the satellite is generated is indicated as "x".

As shown in FIG. 4, it has been found that when the We number is 2 or less, satellites are not generated regardless of a value of the aspect ratio. This has already been seen according to the present inventor's investigation. At a low speed region of 5 m/s or less, it is supposedly indicated that the tail 106 is not split, and is incorporated in the main droplet 105 to form a single liquid droplet. What is to be attended here is that when the discharge port 102 has an aspect ratio of 15 or more, the satellite is eliminated even at the We number of about 10. When the We number is 10, the density ρ is 1.05 g/cm$^3$, the surface tension γ is 50 mN/m, and the width D of the discharge port 102 in the short axis direction is 2 μm, the discharge velocity V is 15 m/s or less. That is, at a high speed discharge region having a discharge speed of 10 m/s or more, it is indicated that the discharge is realized without any satellites.

Figure 5:
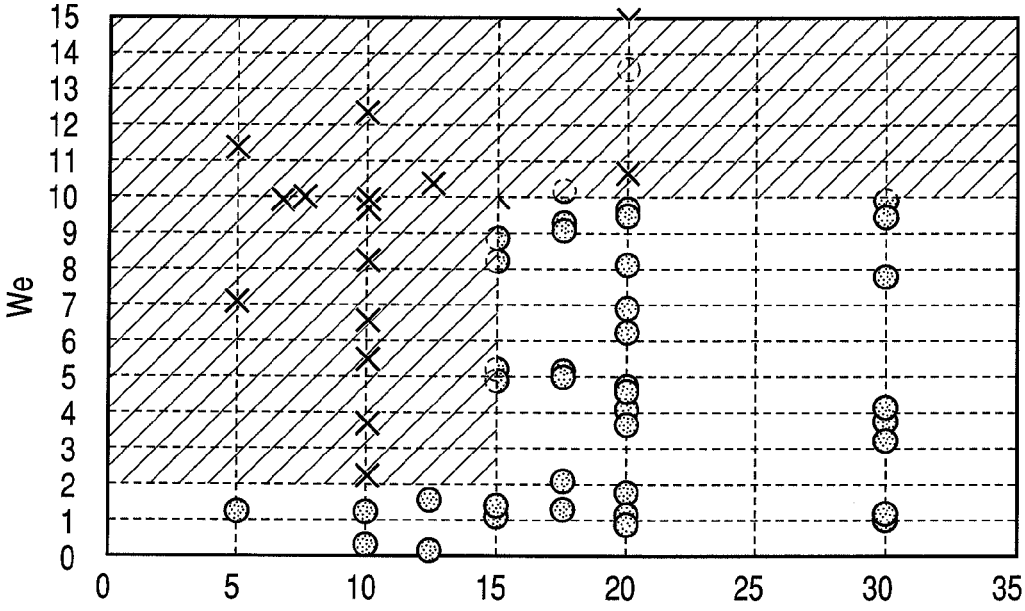
FIG. 5 is a diagram illustrating a distribution of the generated satellites in a case where the We number is 15 or less.

To check this in more detail, examples where the We number was 15 or less were extracted and investigated. FIG. 5 illustrates the result. It is seen from FIG. 5 that when the discharge port constituting the A-type discharge shape has an aspect ratio of 15 or less, as a condition on which the satellite is eliminated, the We number is 2 or less. This does not largely change as compared with the finding already obtained. However, it is indicated that when the discharge port 102 constituting the B-type discharge shape and having a shortened tail has an aspect ratio of 15 or more, as the condition on which the satellite is eliminated, the We number is 10 or less. In consequence, even at the high speed region, the satellite is eliminated.

As a result of the present inventor's investigation, it has been found that when the width D of the slit-like discharge port 102 in the short axis direction is reduced, the tail 106 is easily separated from the ink at the discharge port 102. In the present embodiment, it has been found that the width D in the short axis direction is set to 2.5 μm or less in order to reduce the length of the tail 106 to such an extent that the satellite subsequent to the main droplet 105 can be eliminated.

In the present embodiment, the discharge port 102 is arranged so that the long axis direction of the discharge port 102 crosses an ink flow direction (a direction along the Y1-Y2 line of FIG. 1A) at right angles. However, the long axis direction of the discharge port 102 with respect to the ink flow direction of the ink channel 103 is not limited to this direction. That is, the long axis direction of the discharge port 102 may have an angle of 0°≦θ≦90° with respect to the ink flow direction of the ink channel 103. This also applies to the following examples.

Moreover, in the present embodiment, the constitution of the ink jet discharge head using the electricity-heat conversion member as the ink droplet discharge energy generation device 101 has been described. The constitution of the present embodiment is effective even for an ink jet discharge head using another system such as a piezoelectric device. This also applies to the following examples.

EXAMPLES

Examples and comparative examples of the present invention will hereinafter be described.

Example 1

Table 1 shows a constitution (an aspect ratio, the We number and a dimension of a slit) of a discharge port and physical properties of ink according to Examples 1-1 to 1-5 of the present invention.

TABLE 1

| | Aspect ratio | We number | Slit Width [μm] | Slit Length [μm] | Density [g/cm3] | Surface tension [mN/m] | Discharge speed [m/s] | Discharge amount [pl] | Tail [μm] (satellite) |
|---|---|---|---|---|---|---|---|---|---|
| Example 1-1 | 15 | 8.2 | 2 | 30 | 1.05 | 35 | 11.7 | 0.46 | 10 (none) |
| Example 1-2 | 20 | 8.1 | 2 | 40 | 1.05 | 50 | 13.9 | 0.74 | 10 (none) |
| Example 1-3 | 18 | 5.0 | 2 | 35 | 1.05 | 70 | 13.0 | 0.69 | 9 (none) |
| Example 1-4 | 30 | 9.9 | 2 | 60 | 1.05 | 20 | 9.7 | 0.81 | 14 (none) |
| Example 1-5 | 20 | 5.9 | 2.5 | 50 | 1.05 | 50 | 10.6 | 1.20 | 10 (none) |

Figure 6:
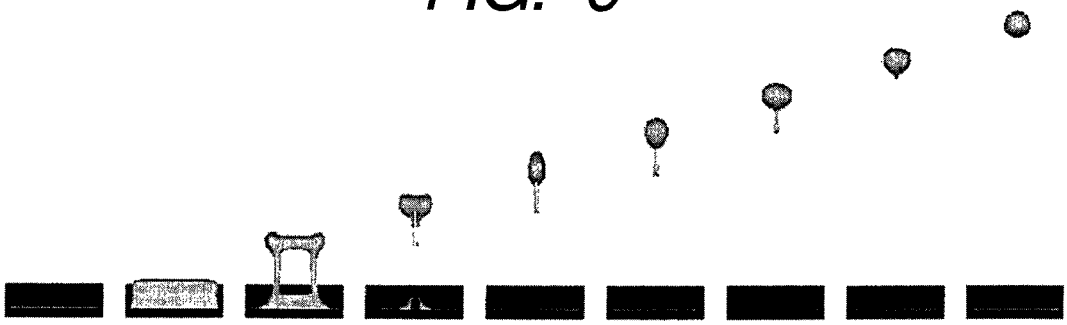
FIG. 6 is a diagram illustrating a behavior of ink during discharge of the ink by an ink discharge simulation according to Example 1 of the present invention.

In order to confirm effects of Examples 1-1 to 1-5, a simulation was performed to measure and evaluate a length of a tail and the number of satellites. As a representative example of Examples 1-1 to 1-5, FIG. 6 illustrates a behavior of ink during discharge of the ink in the discharge simulation of Example 1-1.

In Example 1-1, the discharge port has an aspect ratio of 15 and the We number of 8.2. The discharged ink has a B-type discharge shape as described above. The ink was separated at the center thereof, and gathered close to opposite ends along a long axis direction of a slit-like discharge port to form two tails. The tails had a length of 10 μm. Afterward, the tails were absorbed by the main droplet, and any satellite was not generated behind the main droplet.

In Examples 1-2 to 1-5, two tails were similarly formed, and were sufficiently short so as to be absorbed by the main droplet, and satellites were not generated behind the main droplet.

It has been seen from these results that when an amount of the ink discharged at one discharge operation is 2 pls or less and the We number is 10 or less, the ink can satisfactorily be discharged without generating any satellites.

When Example 1-5 is compared with Example 2-2 to be described below, the discharge port has an aspect ratio of 15 or more and the We number of 10 or less in both of the examples. In Example 1-5, the length of the discharge port in the short axis direction was 2.5 μm, the length of the tail was 10 μm, and satellites were not generated behind the main droplet. On the other hand, in Example 2-2, the length of the discharge port in the short axis direction was 3 μm, the length of the tail was 39 μm, and one satellite was generated behind the main droplet.

In both of the examples, the aspect ratio of the discharge port is 15 or more, and the We number is 10 or less, but in Example 1-5, the discharge amount is 1.2 pls and the length of the discharge port in the short axis direction is 2.5 μm, whereas in Example 2-2, the discharge amount is 2 pls or more and the length of the discharge port in the short axis direction is 3 μm. It can be supposed that the satellite was generated in Example 2-2 owing to the above differences.

Example 2

Table 2 shows a constitution (an aspect ratio, the We number and a dimension of a slit) of a discharge port and physical properties of ink according to Examples 2-1, 2-2 of the present invention. Table 3 shows a constitution (an aspect ratio, the We number and a dimension of a slit) of a discharge port and physical properties of ink according to Comparative Examples 1 to 3.

TABLE 2

| | Aspect ratio | We number | Slit Width [μm] | Slit Length [μm] | Density [g/cm3] | Surface tension [mN/m] | Discharge speed [m/s] | Discharge amount [pl] | Tail [μm] (satellite) |
|---|---|---|---|---|---|---|---|---|---|
| Example 2-1 | 20 | 17.3 | 2 | 40 | 1.05 | 35 | 17.0 | 0.80 | 16 (one satellite) |
| Example 2-2 | 20 | 7.9 | 3 | 60 | 1.05 | 50 | 11.2 | 2.14 | 39 (one satellite) |

TABLE 3

| | Aspect ratio | We number | Slit Width [μm] | Slit Length [μm] | Density [g/cm3] | Surface tension [mN/m] | Discharge speed [m/s] | Discharge amount [pl] | Tail [μm] (satellite) |
|---|---|---|---|---|---|---|---|---|---|
| Comparative Example 1 | 1 | 64.4 | 7.7 | 7.7 | 1.05 | 35 | 16.7 | 0.79 | 81 (four satellites) |
| Comparative Example 2 | 1 | 31.0 | 12 | 12 | 1.05 | 50 | 11.1 | 2.05 | 86 (three satellites) |
| Comparative Example 3 | 10 | 7.5 | 3 | 30 | 1.05 | 50 | 10.9 | 1.03 | 52 (three satellites) |

In Example 1, the example which satisfies conditions such as a discharge port aspect ratio of 15 or more and the We number of 10 or less and in which satellites are not generated behind a main droplet has been described. In Example 2, an example which satisfies a discharge port aspect ratio of 15 or more and in which a small number of satellites are generated but the generation of the satellites is remarkably inhibited will be described.

Figure 7:
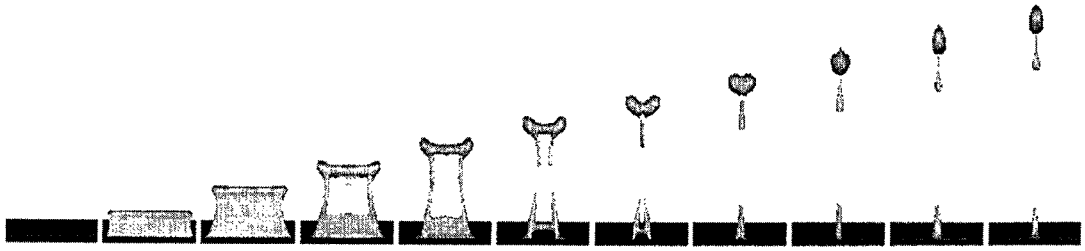
FIG. 7 is a diagram illustrating a behavior of ink during discharge of the ink by an ink discharge simulation according to Example 2 of the present invention.

In order to confirm effects of Examples 2-1, 2-2, a simulation was performed to measure and evaluate a length of a tail and the number of the satellites. FIG. 7 illustrates a behavior of ink during discharge of the ink in the discharge simulation of Example 2-1. In Example 2-1, the aspect ratio of the discharge port was 20, and the We number was 17.3.

Figure 8:
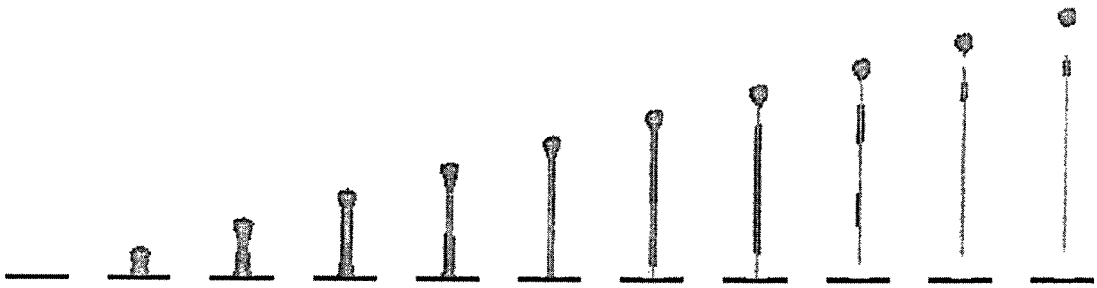
FIG. 8 is a diagram illustrating a behavior of ink during discharge of the ink by an ink discharge simulation of Comparative Example 1.

Moreover, FIG. 8 illustrates a behavior of ink during discharge of the ink in the discharge simulation of Comparative Example 1. In Comparative Example 1, a discharge port had a circular shape, and an aspect ratio of the discharge port between a long axis direction and a short axis direction was one.

In Example 2-1, as shown in FIG. 7, the discharged ink constituted a B-type discharge shape as described above, the ink started to be torn at the center thereof, and the ink gathered close to opposite ends of the discharge port in the long axis direction to form two tails. The tails had a length of 16 μm. On the other hand, in Comparative Example 1, as shown in FIG. 8, the discharged ink constituted an A-type discharge shape as described above, and one tail was formed. The tail had a length of 81 μm. In Example 2-1, the length of the tail was 65 μm shorter than that of Comparative Example 1. With regard to the number of the generated satellites, one satellite was generated in Example 2-1, whereas four satellites were generated in Comparative Example 1.

As apparent from the above result, it is seen that the constitution of Example 2-1 remarkably reduces the satellites as compared with the Comparative Example 1. However, a small number of satellites were generated even in Example 2-1. It is supposed that the example has the discharge port aspect ratio of 15 or more, but does not have the We number of 10, and hence the small number of the satellites are generated.

Furthermore, a discharge simulation was performed in Example 2-2 and Comparative Example 1. In Example 2-2, an aspect ratio of a discharge port was 20, and the We number was 7.9. In Comparative Example 2, a discharge port had a circular shape, and an aspect ratio of the discharge port between a long axis direction and a short axis direction was one.

In Example 2-2, the discharged ink constituted a B-type discharge shape as described above, the ink started to be torn at the center thereof, and the ink gathered close to opposite ends of the discharge port in the long axis direction to form two tails. The tails had a length of 39 μm. On the other hand, in Comparative Example 2, the discharged ink constituted an A-type discharge shape as described above, and one tail was formed. The tail had a length of 86 μm. In Example 2-2, the length of the tail was 47 μm shorter than that of Comparative Example 2.

As apparent from the above result, it is seen that the constitution of Example 2-2 remarkably reduces the satellites as compared with the Comparative Example 2. However, a small number of satellites were generated in the same manner as in Example 2-1. It is supposed that the example has the discharge port aspect ratio of 15 or more, but a discharge amount is 2 pls or more, a width of the discharge port in a short axis direction is as long as 3 μm, and hence the satellites are generated.

Moreover, Example 2-2 is compared with Comparative Example 3. In both of the examples, the width of the discharge port in the short axis direction is 3 μm, but the aspect ratio of the discharge port is 20 in Example 2-2, and the ratio is 10 in Comparative Example 3, unlike the example.

In Example 2-2, the droplet was separated to form two tails, and the tails had a length of 39 μm. On the other hand, in Comparative Example 3, one tail was formed, and the tail had a length of 52 μm. In Example 2-2, a discharge amount was about twice that of Comparative Example 3, but the length of the tail was 13 μm shorter than that of Comparative Example 3. With regard to the number of the generated satellites, one satellite was generated in Example 2-2, while three satellites were generated in Comparative Example 3.

As apparent from the above result, when the aspect ratio of the discharge port is set to 15 or more, the satellites can remarkably be reduced.

Example 3

In Example 3, two discharge ports (an aspect ratio of 15) of Example 1-1 which achieved discharge without any satellite were arranged in parallel. It is to be noted that the two discharge ports communicate with one ink channel.

Table 4 shows a constitution (an aspect ratio, the We number and a dimension of a slit) of a discharge port and physical properties of ink according to Example 3.

TABLE 4

| | Aspect ratio | We number | Slit Width [μm] | Slit Length [μm] | Density [g/cm3] | Surface tension [mN/m] | Discharge speed [m/s] | Discharge amount [pl] | Tail [μm] (satellite) |
|---|---|---|---|---|---|---|---|---|---|
| Example 3 | 15 | 8.8 | 2 | 30 | 1.05 | 35 | 12.1 | 1.38 | 9 (none) |

Figure 9A:
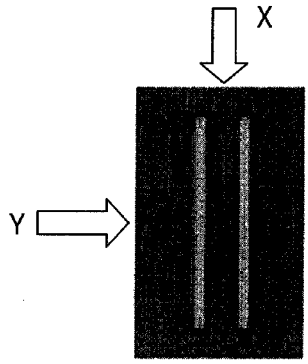
FIG. 9A is a plan view illustrating two discharge ports according to Example 3.
Figure 9B:
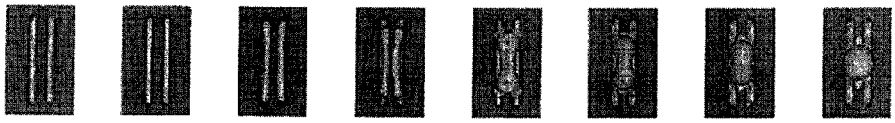
FIGS. 9B, 9C and 9D are diagrams illustrating a simulation result of a behavior of ink at a time when the ink is discharged from the discharge ports according to Example 3.
Figure 9C:
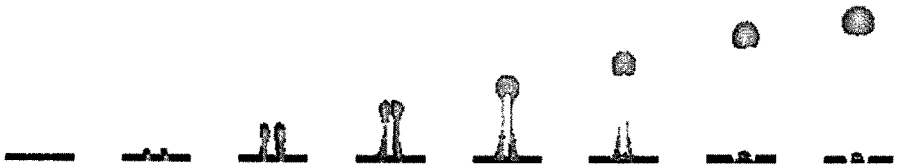
Figure 9D:
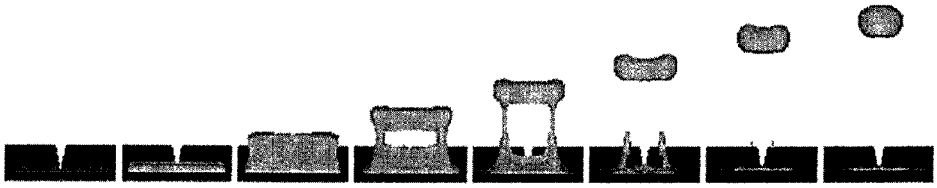

In order to confirm an effect of Example 3, a simulation was performed to measure and evaluate a length of a tail and the number of satellites. FIG. 9A illustrates a plan view of two discharge ports according to the present example. FIG. 9B is a plan view illustrating a simulation result of a behavior of ink at a time when the ink is discharged from the discharge ports according to the present example. FIG. 9C is a diagram illustrating a simulation result of the behavior of the ink as viewed from the X-direction of FIG. 9A. FIG. 9D is a diagram illustrating a simulation result of the behavior of the discharged ink as viewed from the Y-direction of FIG. 9A.

In Example 3, the ink discharged from one discharge port constituted a B-type discharge shape as described above in the same manner as in Example 1-1, the ink started to be torn at the center thereof, and the ink gathered close to opposite ends of the discharge port in a long axis direction to form two tails. In the constitution of Example 3, after two tails were formed at ink droplets discharged from the respective discharge ports, main ink droplets were combined. The resultant tails had a length of 9 μm. The tails were absorbed by the main droplets to achieve the discharge without any satellite. Furthermore, since the ink discharged from the two discharge ports was combined, a discharge amount of ink droplets was twice or more than that of Example 1-1. When ink jet nozzle portions have a limited size and the discharge ports are arranged in accordance with the size of the nozzle portions, a desired amount of the ink droplets can be obtained while keeping a high density of the nozzle portions.

In Example 3, two slit-like discharge ports having an equal size were arranged so as to communicate with one ink channel. The number of discharge ports arranged so as to communicate with the one ink channel is not limited to two, and as many ports as possible may be arranged. Discharge ports of equal size do not have to be arranged with respect to the one ink channel, and the discharge ports having different sizes may be arranged if necessary

Example 4

Figure 10A:
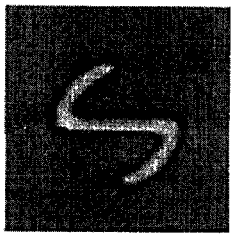
FIG. 10A is a plan view illustrating a discharge port according to Example 4.

FIG. 10A is a plan view illustrating a discharge port according to Example 4 of the present invention. As shown in FIG. 10A, according to the present example, the discharge port has an S-slit-like shape. Table 5 shows a constitution (an aspect ratio, the We number and a dimension of a slit) of the discharge port and physical properties of ink according to Example 4.

TABLE 5

| | Aspect ratio | We number | Slit Width [μm] | Slit Length [μm] | Density [g/cm3] | Surface tension [mN/m] | Discharge speed [m/s] | Discharge amount [pl] | Tail [μm] (satellite) |
|---|---|---|---|---|---|---|---|---|---|
| Example 4 | 17.5 | 3.1 | 2 | 35 | 1.05 | 35 | 7.2 | 0.44 | 9 (none) |

Figure 10B:
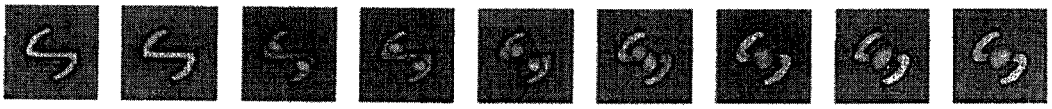
FIGS. 10B and 10C are diagrams illustrating a simulation result of a behavior of ink at a time when the ink is discharged from the discharge port according to Example 4.
Figure 10C:
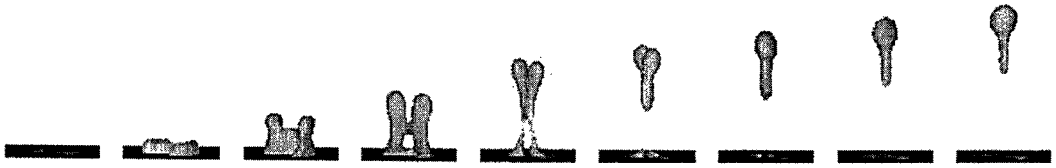

In order to confirm an effect of Example 4, a simulation was performed to measure and evaluate a length of a tail and the number of satellites. FIG. 10B is a plan view illustrating a simulation result of a behavior of the ink at a time when the ink is discharged from the discharge port of the present example. FIG. 10C is a front view illustrating a simulation result of a behavior of the ink at a time when the ink is discharged from the discharge port of the present example.

In Example 4, the ink discharged from the discharge port constituted a B-type discharge shape as described above in the same manner as in a linear-slit-like discharge port, the ink started to be torn at the center thereof, and the ink gathered close to opposite ends of the discharge port in the long axis direction to form two tails. The tails had a length of 9 μm. Afterward, the tails were absorbed by a main droplet, and satellites were not generated behind the main droplet.

When the discharge port has an aspect ratio of 15 or more, it is not necessary that the discharge port have a linear slit shape. Even when the discharge port has a curved shape such as the S-shape of Example 4 or a C-shape, a satellite suppressing effect can be obtained. When the We number is 10 or less as in Example 4, the discharge can be achieved without any satellite. Furthermore, even when there is a restriction on a size of the discharge ports, the discharge ports having the curved shape can efficiently be arranged.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-300619, filed Nov. 6, 2006, which is hereby incorporated by reference herein in its entirety.

What is claimed is:

1. A liquid discharge method of a liquid discharge head including a discharge port which discharges a liquid, a channel which communicates with the discharge port and an energy generation unit which is disposed opposite to the discharge port and which generates energy for use in discharging the liquid, the method comprising:

driving the energy generation unit, and then connecting a tip portion of the liquid discharged from the discharge port to the liquid at the discharge port via at least two liquid columns; and cutting the at least two liquid columns to separate the tip portion of the liquid from the liquid at the discharge port.

2. A liquid discharge head comprising: a discharge port configured to discharge a liquid; a channel communicating with the discharge port; and an energy generation unit disposed opposite to the discharge port and configured to generate energy for use in discharging the liquid, wherein the discharge port has a slit-like shape, and satisfies a relation of $L \geqq 15D$, in which L is a length of the discharge port in a long axis direction and D is a width of the port in a short axis direction, and wherein a volume of the liquid discharged from the discharge port is 2 pls or less, and the Weber number is 10 or less, the Weber number being defined by $We=\rho DV^2/\gamma$, in which $\gamma$ is surface tension of the liquid, $\rho$ is a density of the liquid, and V is a velocity of the liquid discharged from the discharge port in a discharge direction.

* * * * *